United States Patent [19]

Nilssen

[11] Patent Number: 4,893,064

[45] Date of Patent: Jan. 9, 1990

[54] OPERATING SYSTEM FOR SKIN TREATMENT APPARATUS

[76] Inventor: Ole K. Nilssen, Caesar Dr., Rte. 5, Barrington, Ill. 60010

[21] Appl. No.: 754,982

[22] Filed: Jul. 15, 1985

[51] Int. Cl.[4] ..... H05B 41/00

[52] U.S. Cl. ..... 315/317; 315/312; 315/324; 315/DIG. 5; 250/504 R

[58] Field of Search ..... 315/160, 209 R, 312, 315/317, 318, 319, 324, DIG. 5; 363/50, 159, 172; 313/487

[56] References Cited

U.S. PATENT DOCUMENTS 4,438,372 3/1984 Zuchtriegel ..... 315/224
4,499,403 2/1985 Leppelmeier et al. ..... 313/487

*Primary Examiner*—Benedict V. Safourek
*Assistant Examiner*—T. Salindong

[57] ABSTRACT

A fluorescent lamp operating system for a skin treatment apparatus comprises: (i) a plurality of pairs of fluorescent lamps for providing luminous radiation, each pair of lamps being adapted to be powered from 30 kHz/120 Volt by way of a high-Q series-resonant L-C ballasting circuit; (ii) a relatively low-power frequency converter connected with the power line and operable to provide power for heating the cathodes in these fluorescent lamps, thereby conditioning the lamps for easy starting; (iii) a relatively high-power frequency converter also connected with a power line and operable to provide the 30 kHz/120 Volt required for operating the plurality of pairs of fluorescent lamps by way of the high-Q series-resonant L-C ballasting circuit; and (iv) delay means operable to prevent the 30 kHz/120 Volt provided by the high-power frequency converter from being applied to the fluorescent lamps until after power has been applied to heat the lamp cathodes for at least one second. Each high-Q series-resonant L-C ballast circuit is protected from over-voltages by a Varistor, which acts as a substitute load in case a lamp is removed or fails to operate properly. If current should flow through the Varistors for more than about 50 milliseconds, a short circuit is placed across that Varistor, thereby protecting that Varistor from destruction without affecting the operation of the other L-C ballast circuits.

20 Claims, 4 Drawing Sheets

OPERATING SYSTEM FOR SKIN TREATMENT APPARATUS

BACKGROUND OF THE INVENTION

1. Field of Invention

The present invention relates to an operating system for powering and controlling a plurality of fluorescent lamps in an apparatus for radiative skin treatment.

2. Prior Art

Presently when ballasting a plurality of fluorescent lamps, such as in a sun tanning bed that typically comprises between 20 and 40 fluorescent lamps, with each lamp being 72" long and requiring about 100 Watt of power input for effective operation, these lamps are powered by way of a plurality of individual ballasts, with each ballast powering one or two lamps.

The fluorescent lamps most often used in these applications are of the so-called rapid-start type; which implies that each lamp requires four separate supply wires for proper operation. As a result, the number of wires required for powering 20-to-40 fluorescent lamps gets to be very high. Moreover, light output control is not readily achievable.

SUMMARY OF THE INVENTION

Brief Description

In its preferred embodiment, subject invention constitutes an operating system for a sun tanning or other skin treatment apparatus. This operating system is adapted to be powered from an ordinary electric utility power line and comprises:

(a) fluorescent lamps for providing luminous radiation, these lamps being arranged in the form of a plurality of separately identifiable lamp-ballast assemblies, each such assembly having (i) a pair of fluorescent lamps, (ii) a high-Q seriesresonant L-C ballasting circuit operable to power the pair of lamps from 30 kHz/120 Volt, and (iii) a first and a second set of assembly terminals, one set located at each end of the assembly;

(b) a central frequency-converting power supply connected with said power line and having: (i) a relatively low-power frequency converter operable to provide a first 30 kHz/120 Volt AC voltage for heating the cathodes in these fluorescent lamps, thereby to condition the lamps for easy starting, (ii) a relatively high-power frequency converter operable to provide a second 30 kHz/120 Volt AC voltage for operating the plurality of lamp-ballast assemblies, (iii) a first and a second set of central terminals, and (v) delay means operable to prevent the second 30 kHz/120 Volt AC voltage from being applied to the lamp assemblies until after the first 30 kHz/120 Volt AC voltage has had an opportunity to heat the lamp cathodes for at least one second;

(c) Varistor circuit protection means connected with each individual L-C ballasting circuit and operative to act as a substitute load in case a lamp is removed or fails to operate. If current flows through the Varistor for more than about 50 milli-seconds, a short circuit is automatically placed across it, thereby protecting the Varistor from destruction; and (d) a first and a second distribution conductor means operable to provide connection between said first and second sets of central terminals and said first and second sets of assembly terminals.

DESCRIPTION OF THE PREFERRED EMBODIMENT

Details of Construction

Figure 1:
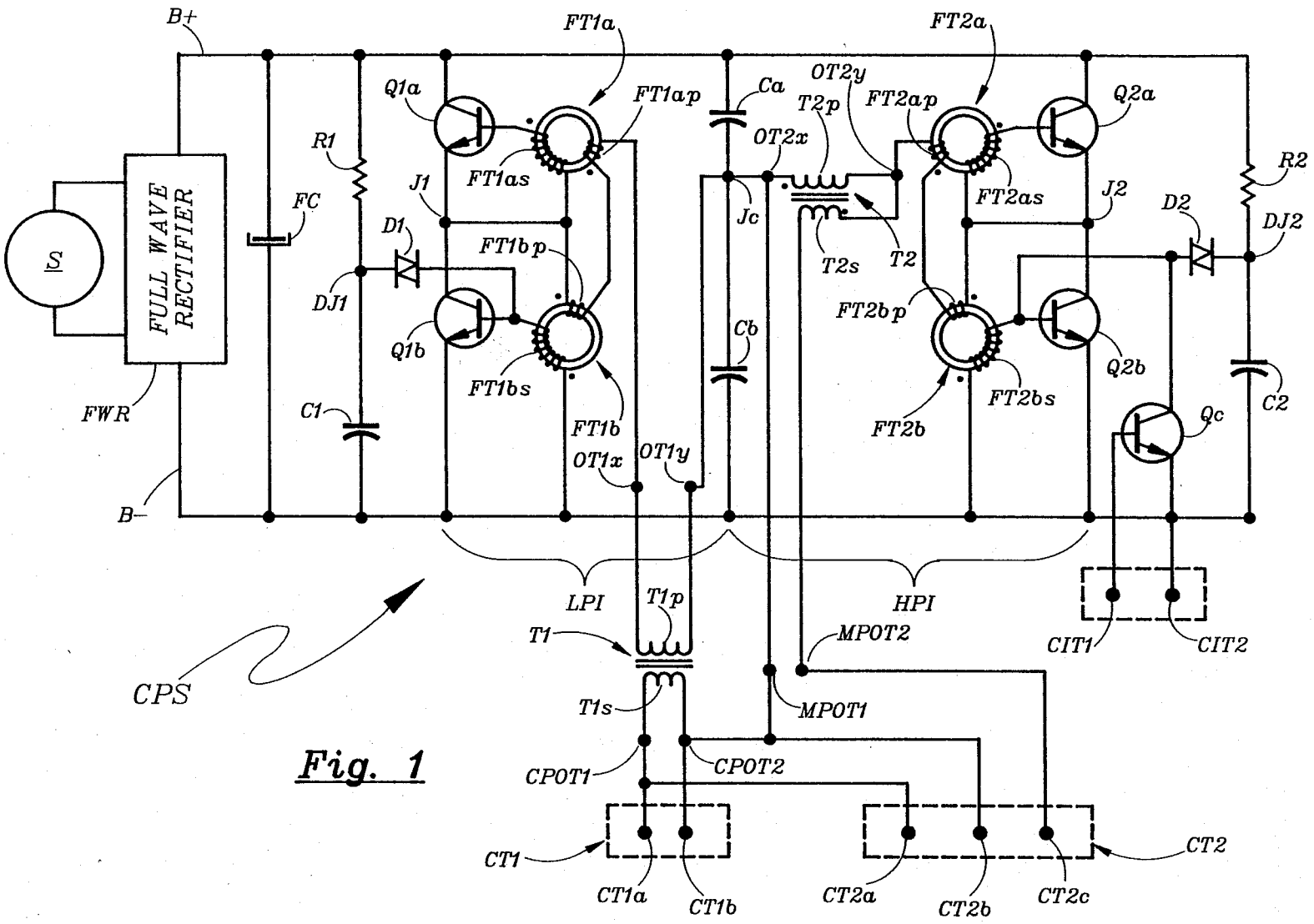
FIG. 1 provides a schematic illustration of the central frequency-converting power supply.

FIG. 1 shows an AC voltage source S, which in reality is an ordinary 120 Volt/60 Hz electric utility power line.

Connected to S is a full-wave rectifier FWR combined with a ripple filter capacitor RFC; which combination rectifies the AC voltage from S and provides a relatively constant-magnitude ripple-free DC voltage between a positive power bus B+ and a negative power bus B−.

A first pair of transistors Q1a and Q1b are connected in series between the B+ bus and the B− bus in such a way that the collector of Q1a is connected to the B+ bus, the emitter of Q1a is connected with the collector of Q1b at a junction J1, and the emitter of Q1b is connected with the B− bus.

A second pair of transistor Q2a and Q2b are connected in series between the B+ bus and the B− but in such a way that the collector of Q2a is connected to the B+ bus, the emitter of Q2a is connected with the collector of Q2b at a junction J2, and the emitter of Q2b is connected with the B− bus.

Primary winding FT1ap of saturable feedback transformer FT1a and primary winding FT1bp of saturable feedback transformer FT1b are connected in series between junction J1 and output terminal OT1x. Another output terminal OT1y is connected with junction JC between capacitors Ca and Cb; which capacitors are connected in series between the B+ bus and the B− bus.

Primary winding FT2ap of saturable feedback transformer FT2a and primary winding FT2bp of saturable feedback transformer FT2b are connected in series between junction J2 and output terminal OT2y. Another output terminal OT2x is connected with junction JC.

Secondary winding FT1as of feedback transformer FT1a is connected between the base and the emitter of transistor Q1a; and secondary winding FT1bs of feedback transformer FT1b is connected between the base and the emitter of transistor Q1b.

Secondary winding FT2a of feedback transformer FT2a is connected between the base and the emitter of transistor Q2a; and secondary winding FT2bs of feedback transformer FT2b is connected between the base and the emitter of transistor Q2b.

A resistor R1 is connected between the B+ but and a junction DJ1; and a capacitor C1 is connected between junction DJ1 and B− bus. A Diac D1 is connected between junction DJ1 and the base of transistor Q1b.

A resistor R2 is connected between the B+ bus and a junction DJ2; and a capacitor C2 is connected between junction DJ2 and the B− bus. A Diac D2 is connected between junction DJ2 and the base of transistor Q2b.

A control transistor Qc is connected with its collector to the base of transistor Q2b and with its emitter to the B− bus. The base of this control transistor is connected with a first control input terminal CIT1. A second control input terminal CIT2 is connected with the B− bus.

Primary winding T1p of a transformer T1 is connected with inverter output terminals OT1x and OT1y. Secondary winding T1s is connected with cathode power output terminals CPOT1 and CPOT2.

Primary winding T2p of a transformer T2 is connected between inverter output terminals OT2x and OT2y. Secondary winding T2s is connected between terminal OT2y and a main power output terminal MPOT2. A main power output terminal MPOT1 is connected directly with inverter output terminal OT2x.

A first set of central terminals CT1 has two individual central terminals CT1a and CT1b; which terminals are connected with terminals CPOT1 and CPOT2, respectively.

A second set of central terminals CT2 has three individual central terminals CT2a, CT2b, and CT2c. Of these terminals, CT2a and CT2b are connected with CPOT1 and CPOT2 respectively; and CT2b and CT2c are connected with MPOT1 and MPOT2, respectively.

The assembly consisting of transistors Q1a and Q1b, feedback transformers FT1a and FT1b, and output terminals OT1x and OT1y is referred to as low power inverter LPI. The assembly consisting of transistors Q2a and Q2b, feedback transformers FT2a and FT2b, and output terminals OT2x and OT2y is referred to as high power inverter HPI. The overall power supply of FIG. 1 is referred to as central power supply CPS.

Figure 2:
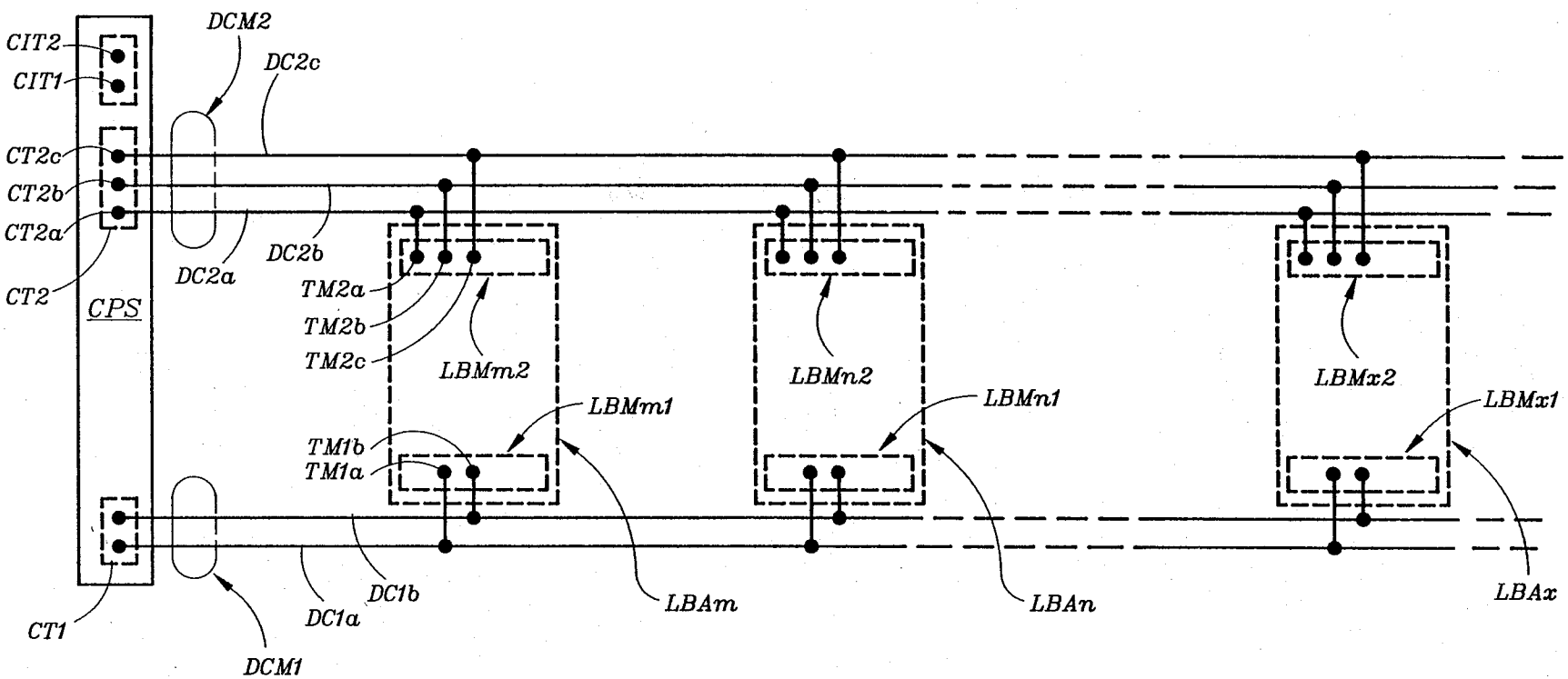
FIG. 2 diagrammatically describes the overall operating system in its preferred embodiment, including the central power supply, two sets of distribution conductors coming therefrom, and plural lamp-ballast assemblies connected between these two sets of distribution conductors.

FIG. 2 shows a first and a second set of distribution conductor means DCM1 and DCM2 connected respectively with the first and the second set of central terminals CT1 and CT2 on central power supply CPS.

The first set of distribution conductor means comprises two individual distribution conductors DC1a and DC1b; which are connected with central terminals CT1a and CT1b, respectively.

The second set of distribution conductor means comprises three individual distribution conductors DC2a, DC2b, and DC2c; which are connected with central terminals CT2a, CT2b, and CT2c, respectively.

Located between and connected with the two distribution conductor means DCM1 and DCM2, are a plurality of lamp-ballast assemblies LBAm, LBAn—LBAx. Each lamp-ballast assembly comprises two lamp-ballast matching means: LBMm1 and LBMm2, LBMn1 and LBMn2—LBM×1 and LBM×2, respectively.

Lamp-ballast matching means LBMm1 has two terminals Tm1a and Tm1b; which are connected to distribution conductors DC1a and DC1b, respectively. Lamp-ballast matching means LBMm2 has three individual terminals Tm2a, Tm2b, and Tm2c; which are connected to distribution conductors DC2a, DC2b, and DC2c, respectively.

Similarly, lamp-ballast matching means LBMn1 has two terminals, lamp-ballast matching means LBMn2 has three terminals, lamp-ballast matching means LBMx1 has two terminals, and lampballast matching means LBMx2 has three terminals; which terminals are all connected to individual distribution conductors in a manner that is analogous to the manner in which the terminals of lamp-ballast matching means LBNm1 and LBMm2 are connected.

Figure 3:
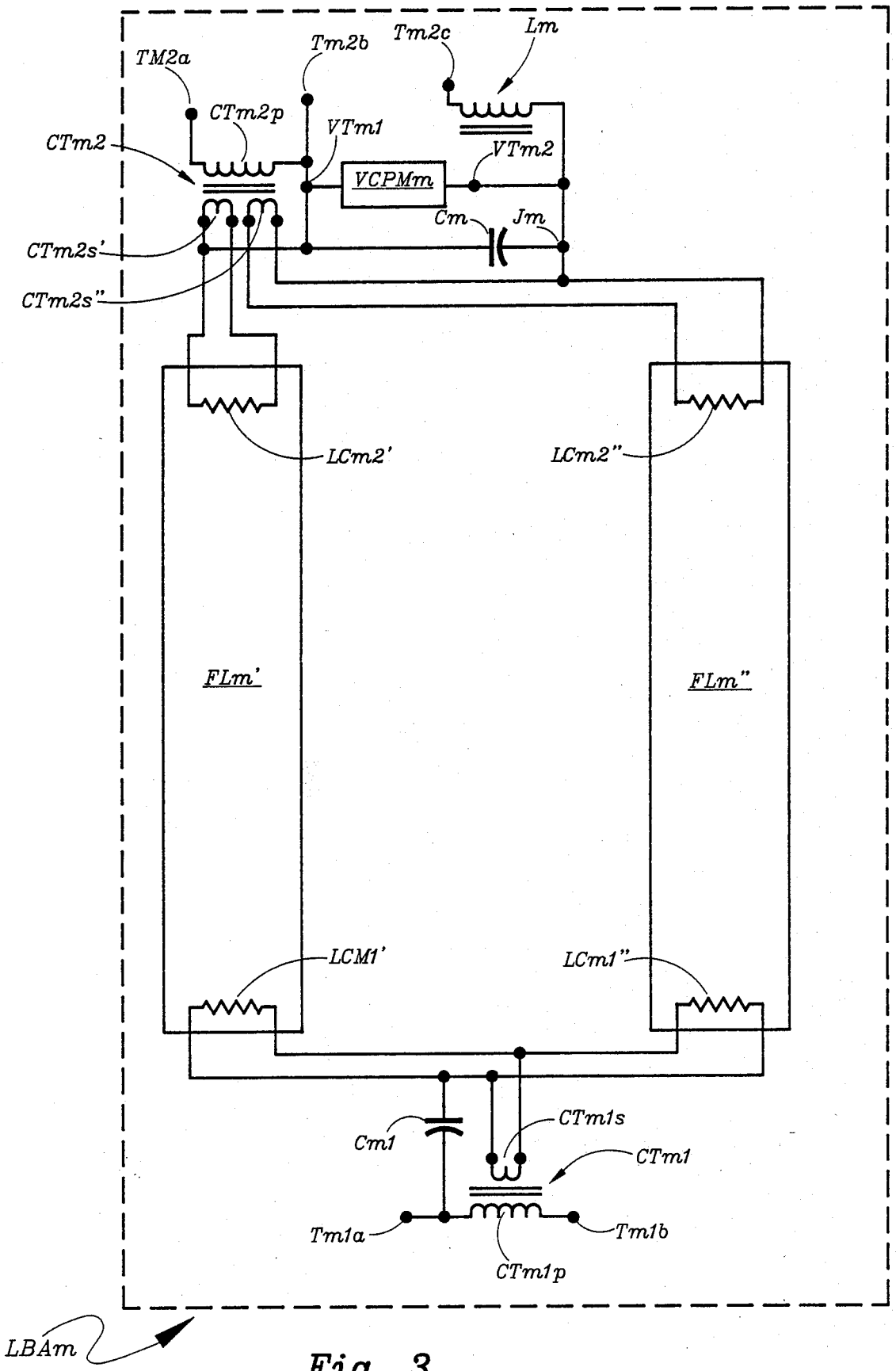
FIG. 3 schematically provides details of a lamp-ballast assembly, including its L-C ballasting circuit.

FIG. 3 illustrates electric circuit details of lamp-ballast assembly LBAm.

A cathode transformer CTml has a primary winding CTmlp connected between terminals Tm1a and Tm1b; and it has a secondary winding CTmls connected with the parallel-connected lamp cathodes LCml'and LCm1" of fluorescent lamps FLm' and FLm", respectively.

A capacitor Cml is connected between terminal Tm1a and one of the terminals of secondary winding CTmls.

A cathode transformer CTm2 has a primary winding CTm2p connected between terminals Tm2a and Tm2b; and it has two secondary winding CTm2s' and CTm2s" connected with lamp cathodes LCm2' and LCm2" of fluorescent lamps FLm' and FLm", respectively.

An inductor Lm is connected between terminal Tm2c and a junction Jm; and a capacitor Cm is connected between junction Jm and terminal Tm2b. Terminal Tm2b is connected with one of the terminals of lamp cathode LCm2'.

A Varistor circuit protection means VCPMm is connected between terminal Tm2b and junction Jm. This Varistor protection means has terminals VTm1 and VTm2.

Figure 4:
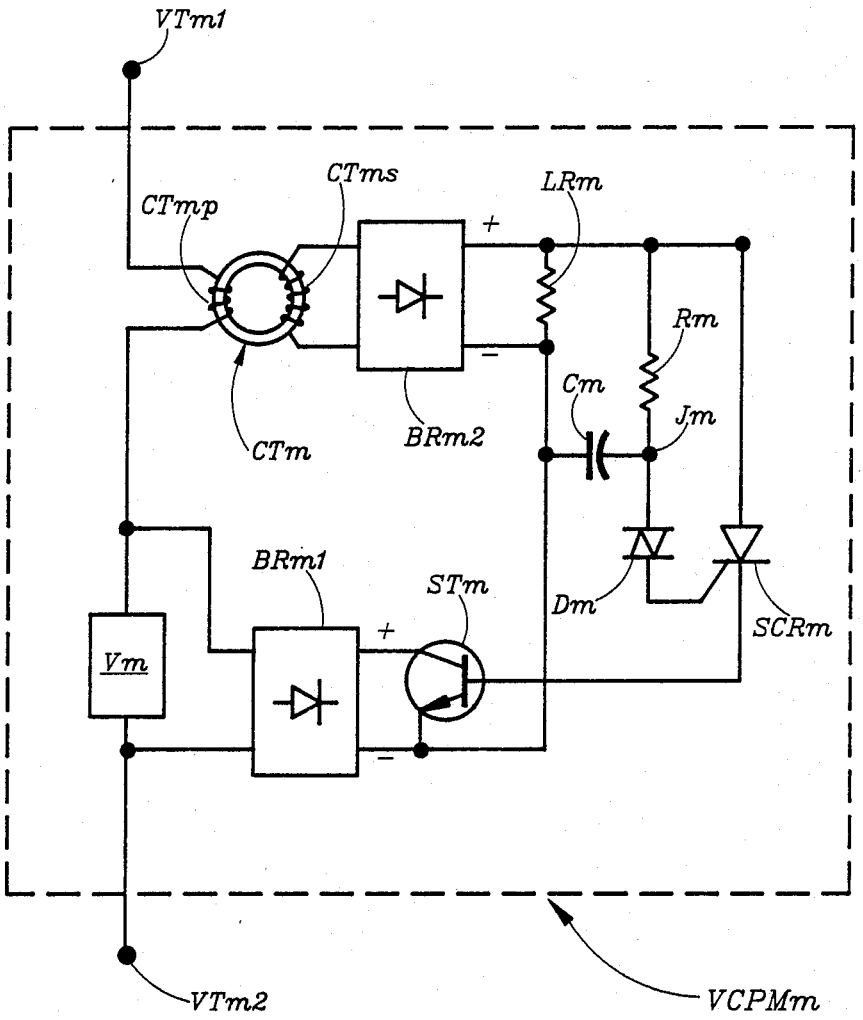
FIG. 4 provides details of the Varistor circuit protection means that is used with each L-C ballasting circuit.

FIG. 4 illustrates details of Varistor circuit protection means VCPMm.

The primary winding CTmp of a current transformer CTm and a Varistor Vm are connected in series between terminals VTm1 and VTm2 of the complete Varistor circuit protection means VCPMm. The input terminals of a first bridge rectifier BRml are connected directly across the terminals of the Varistor; and the output terminals of this first bridge rectifier are connected with the emitter and collector of an NPN shorting transistor STm, with the positive output terminal of BRm1 connected with the collector of this transistor.

Secondary winding CTms of current transformer CTm is connected with the input terminals of a second bridge rectifier BRm2. A load resistor LRm is connected directly across the output terminals of BR2m. The negative output terminal of BR2m is connected with the emitter of transistor STm; and the positive output terminal of BR2m is connected with the anode of a thyristor SCRm. The cathode of SCRm is connected with the base of transistor STm.

A resistor Rm is connected between the positive output terminal of BRm2 and a junction Jm; a capacitor Cmis connected between junction Jm and the negative output terminal of BRm2; and a Diac Dm is connected between junction Jm and the gate of thyristor SCRm.

A load resistor LRm is connected directly across the output of BRm2.

DETAILS OF OPERATION

The operation of the central power supply CPS of FIG. 1 may be explained as follows.

FIG. 1 shows two half-bridge inverters: a low power inverter LPI consisting of transistors Q1a and Q1b with their respective saturable positive feedback transformers FT1a and FT1b; and a high power inverter HPI consisting of transistors Q2a and Q2b with their respective saturable positive feedback transformers FT2a and FT2b.

Both inverters are capable of self-oscillation by way of positive feedback. When they do oscillate, the frequency of oscillation is about 30 kHz. For further explanation of the operation of this type of inverter, reference is made to U.S. Pat. No. 4,184,128 issued to Nilssen.

Each of these inverters has to be triggered into oscillation and comprises its own trigger circuit to effect this triggering. By way of the time-constants associated with the two trigger circuits, the triggering is so arranged that the LPI inverter gets its initial trigger pulse within about 100 milli-seconds after power line voltage is applied to the overall central power supply CPS; whereas the HPI inverter does not get its initial trigger pulse until about 1.5 seconds later.

Both the half-bridge inverters use capacitors Ca and Cb to provide for an effective center-tap between the B− bus and the B+ bus—this center-tap being junction JC.

When power line voltage is initially applied to the arrangement of FIG. 1, inverter LPI will commence operation almost immediately, receiving the requisite trigger pulse by way of trigger assembly Rl/Cl/Dl. The time-constant associated with Rl/Cl is such as to cause the voltage on Cl to reach a level high enough for Diac Dl to break down within about 100 milliseconds after the application of B+ voltage.

Inverter HPI, on the other hand, will not commence operation until about 1.5 seconds later.

After the initial triggering, each inverter will continue to receive repeated trigger pulses for as long as B+ voltage is present. While most often such repeated triggering is of little consequence, it is sometimes desirable to avoid it altogether; which may be accomplished by adding a first diode between junction DJ1 and the collector of transistor Q1b and a second diode between junction DJ2 and the collector of transistor Q2b—in both cases with the anodes of the diodes being connected with the junctions.

In other words, when power line voltage is initially applied to the central power supply, power will be supplied from the LPI inverter to the lamp cathodes for about 1.5 second before output voltage will be supplied from the HPI inverter to provide main starting/operating voltage to the rapid-start fluorescent lamps.

Thus, by the time this main starting/operating voltage is supplied to the lamps, the lamp cathodes will have reached full incandescence, and lamp ignition will then occur substantially instantaneously. Yet, the magnitude of the lamp starting voltage need not be any higher than that normally associated with rapid-start lamps. Moreover, lamp starting will be even more gentle than with conventional rapid-starting.

In normal operation, both inverters will provide a relatively high-frequency (30 kHz) squarewave AC voltage of substantially constant magnitude.

By way of transformer T1, the output from low-power inverter LPI is applied between central terminals CT1a/CT1b, as well as between central terminals CT2a/CT2b. By way of auto-transformer T2, the output from high-power inverter HPI is applied between central terminals CT2b/CT2c. Thus, central terminal CT2b acts as a common conductor for the output from both inverters.

With reference to FIG. 2, it is seen that central terminals CT1a/CT1b (CT1) and CT2a/CT2b/CT2c (CT2) are connected with distribution conductor means DCM1 and DCM2, respectively; and, by way of these distribution conductor means, each and every one of the plurality of lamp-ballast assemblies is connected with these central terminals.

With reference to FIG. 3, it is noted that—by way of an isolating voltage transformer (ex: CTml)—the voltage provided from central terminals CT1a/CT1b is used for heating two of the cathodes of the two fluorescent lamps in each lamp-ballast assembly.

Also, by way of a small capacitor (ex: Cm1), the voltage from central terminal CT1a is applied to the two connected cathodes (ex: LCml'/LCml")—the purpose being that of aiding in the starting of the fluorescent lamps. (Since the frequency of inverter LPI is not exactly the same as that of inverter HPI, the phasing of the squarewave voltage across central terminals CT1a and CT1b varies in relationship to that of the squarewave voltage across central terminals CT2b and CT2c; which implies that, at least during part of the time, the voltage provided by distribution conductor means DCM1 adds to the voltage provided by distribution conductor means DCM2—as far as lamp starting voltage is concerned.)

By way of an er isolating voltage transformer (ex: CTm2), the voltage provided from central terminals CT2a/CT2b is used for heating the other two cathodes (ex: LCm2'/LCm2") of the two fluorescent lamps in each lamp-ballast assembly.

Thus, the two lamps (ex: FLm'/FLm") in each lamp-ballast assembly are series-connected; and these series-connected lamps are connected in parallel with a capacitor (ex: Cm) to form a lamp-capacitor parallel-combination, which parallel-combination is connected in series with an inductor (ex: Lm) to form an overall series-tuned L-C circuit connected between those two of the lamp-ballast assembly's input terminals (ex: Tm2b/Tm2c) that are connected with central terminals CT2b and CT2c. Thus, with this series-tuned L-C circuit being resonant at or near the fundamental frequency of the squarewave voltage provided between central terminals CT2b and CT2c, the overall arrangement provides for resonant ballasting wherein the resonant L-C circuit is series-excited and parallel-loaded.

Both the capacitor and the inductor have relatively high Q-factors; which implies that there will be a substantial Q-multiplication effect. That is, absent any loading, the magnitude of the voltage developing across the capacitor will be larger by a factor of Q in comparison to the magnitude of the voltage applied to the series-resonant L-C circuit. Since the net unloaded Q-factor of the L-C circuit in the preferred embodiment is over 100, the magnitude of the voltage developing across the capacitor—assuming linear operation and no breakdown—would reach 12,000 Volt with an input of 120 Volt.

However, the L-C circuit is loaded both by the two seriesconnected fluorescent lamps and the Varistor circuit protection means (ex: VCPMm of FIG. 4)—this protection means being in effect connected in parallel with the two series-connected lamps.

By way of a Varistor, this Varistor circuit protection means limits the maximum voltage magnitude that can be provided across its input terminals, and therefore across the two lamps—as well as across the capacitor of the L-C circuit.

The limiting or clamping voltage of the Varistor is so chosen that—in the absence of the fluorescent lamps—the magnitude of the voltage developing across the capacitor is just right for proper rapid-starting of the two series-connected lamps.

With the Varistor chosen so as to clamp the voltage across the capacitor to a magnitude suitable for rapid-starting of the series-connected lamps, substantially no current will flow through the Varistor after the lamps have started. Moreover, the lamps will not start if the cathodes are non-incandescent.

Thus, when the lamps' cathodes are fully incandescent, the lamps will rapid-start in a matter of a few milli-seconds. However, due to the voltage-magnitude-limiting provided by the Varistor, with cold cathodes the lamps won't start at all.

If, in lamp-ballast assembly LBAm, for some reason the lamps should not start—perhaps because their cathodes had not yet reached incandescence, or perhaps because they were damaged, worn out, or otherwise inoperative, or perhaps because they were disconnected—Varistor Vm will conduct, thereby protecting the inverter as well as the various circuit elements from the destructively high currents and voltages that would otherwise occur.

That is, the Varistor serves two functions: (i) it provides for the proper magnitude lamp starting voltage, and (ii) it protects the inverter and the circuit elements from damage due to over-current and/or over-voltage.

However, when the Varistor conducts, it dissipates a large amount of power—on the order of 400 Watt in the preferred embodiment; and, while the Varistor can indeed handle such high power dissipations for a brief period (it can readily absorb as much as 100 Joule within a few milli-seconds), it can not do so on a continuous basis. In fact, on a continuous basis, most ordinary Varistors can not handle more than about 1.0 Watt of dissipation.

Thus, to protect the Varistor from damage, as well as to avoid waste of energy, it is necessary to prevent the Varistor from acting as a voltage limiter for longer than a brief period of time; which is exactly what is accomplished by the rest of the component within the Varistor circuit protection means VCPMm of FIG. 4.

When the Varistor provides its voltage-limiting function, current flows through the primary winding of current transformer CTm. This current is then full-wave rectified by rectifier BRm2 and provided in the form of a DC voltage of proportional magnitude across load resistor LRm. By way of resistor Rm, this DC voltage will cause capacitor Cm to charge to the point where, within a period of about 50 milli-seconds—Diac Dm breaks down and thereby triggers SCRm into conduction. With SCRm conducting, all of the unidirectional current available from the output of rectifier BRm2 is provided to the base of transistor STm; which then becomes an effective short circuit across the output of rectifier BRml; which, in turn, provides for an effective short circuit across Varistor Vm.

In respect to the central power supply of FIG. 1, it is noted that—by providing control voltage between control input terminals CIT1 and CIT2—control transistor Qc may be turned ON and OFF. With this control transistor ON (i.e., in a forwardly conducting state), the HPI inverter is prevented from oscillating; which implies that no output of main lamp starting/ operating voltage is provided.

Thus, by providing a relatively low-magnitude control signal between terminals CIT1 and CIT2, the light output from the whole array of lamps in FIG. 2 can be turned ON and OFF.

OPERATION OF THE COMPLETE SYSTEM

With reference to FIGS. 1, 3, and 4, the operation of the complete system of FIG. 2 may be described as follows.

(a) Upon initial application of power from the power line, inverter LPI immediately commences operation, thereby immediately starting to provide heating power to all the cathodes of all the fluorescent lamps in all of the plural lamp-ballast assemblies. Thus, within about 1.5 second after this initial application of power, all the lamp cathodes are incandescent.

(b) About 1.5 second after initial application of power from the power line, inverter HPI commences operation, thereby providing operating power to all the fluorescent lamps. Since by now all the lamps have incandescent cathodes, lamp starting will take place within a few milli-seconds.

(c) During the few milli-seconds before the lamps start, the L-C series-resonant ballasting circuits are each loaded with a Varistor, thereby preventing destructive over-voltages.

(d) However, if—in any one of the lamp-ballast assemblies —the lamps should not start within about 50 milli-seconds, an effective short circuit is placed across the Varisto, thereby protecting this Varistor from excessive power dissipation.

(e) At this point it should be noted that a Varistor—although it can absorb a very large amount of power for a brief period of time—can only absorb a miniscule amount of power on an average basis: a large-capacity Varistor is typically rated at about 1 Watt average power, although it may have a rating of more than 100 Joule in terms of energy-absorbing capacity. Thus, in subject system, a Varistor will indeed be able for 50 milli-second or so to safely absorb the approximately 400 Watt or power dissipation it is subjected to in case a pair of lamps fails to start—thereby absorbing a total amount of energy of about 20 Joule. However, within a maximum average power dissipation of 1 Watt, it would not be able to absorb such an amount of energy more often than once every 20 seconds.

(f) Due to the resonant nature of the ballasting circuits, the current flowing into each lamp-ballast combination will be substantially sinusoidal in waveshape even though the driving voltage is a squarewave.

(g) The fundamental nature of a high-Q resonant seriesexcited L-C circuit that is parallel-loaded with a gas discharge lamp, is one of providing this lamp with current from the near-equivalent of an ideal current source, with the magnitude of the current provided to the lamp being roughly proportional to the magnitude of the driving voltage, and the magnitude of the power being provided to the lamp being roughly proportional to the magnitude of the voltage present across the lamp.

(h) Due to this fundamental nature of the series-excited parallel-loaded high-Q resonant L-C circuit, it is totally permissible to parallel-load this L-C circuit with a short circuit (although it is not safe to parallel-load it with an open circuit). Thus, whenever a Varistor circuit protection means is called upon to protect the Varistor from excessive power dissipation, it does so by providing an effective short circuit across the Varistor; which is to say that the L-C circuit becomes parallel-loaded with an effective short circuit. And, of course, there is no power dissipation associated with such a load.

(i) The amount of power that has to be provided by the low-power inverter LPI is less than 10% of the amount of power that has to be provided by high-power inverter HPI.

(j) The fluorescent lamps are started in a particularly gentle rapid-start fashion: the cathodes are allowed to reach full incandescence before lamp operating voltage is applied; and lamp starting aid is provided both by way of a starting capacitor (ex: Cm1 in FIG. 3) and by way of providing a ground-plane next to each lamp. (The ground-plane is not shown, but is indeed present by way of a grounded reflector means mounted directly behind all the lamps.)

(k) For extra high power levels, it would be advantageous to use a full-bridge arrangement (instead of the half-bridge arrangement shown) for high-power inverter HPI. That way, about 30kHz/160Volt would be provided directly from the inverter, and there would be no need to use a transformer at the output.

(l) There is no special reason to provide for an output voltage magnitude of either 120 or 160 Volt RMS. In fact, the most suitable magnitude for the output voltage of the HPI inverter might be about 300 Volt RMS; which magnitude can readily be provided directly from the inverter output by way of using a full bridge inverter in combination with a voltage-doubling rectifier-filter means at the power line input.

(m) Because the lamp supply voltage is removed within a few milli-seconds if a fluorescent lamp is disconnected from the circuit, the lamp-ballast arrangement of FIG. 3 exhibits a high degree of safety from electric shock hazard.

Additional Comments

Otherwise, the following points should be noted.

(n) Capacitors Ca and Cb of FIG. 1 are sized such as not to store a significant amount of energy in comparison to the amount of energy drawn by the central power supply during one complete half-cycle of the 120 Volt/60 Hz power line voltage, while at the same time to store an amount of energy that is several times as large as the amount of energy used by the inverters during one half-cycle of the 30 kHz inverter output voltage.

(o) Extra high operating efficiency can be achieved by removing the externally supplied cathode heating power once the lamps have started. This may be simply accomplished by disabling low-power inverter LPI as soon as high-power inverter HPI commences operation.

(p) Instead of using two separate inverters (ex: LPI and HPI), a single inverter may be used -- with switch means operable to provide the requisite delay in applying the 30 kHz/120 Volt operating power to the lamps.

(q) It is noted that distribution conductors DC1a, DC1b and DC2a may be totally eliminated, yet the system would still be operable, albeit that the fluorescent lamps would then operate in an instant-start manner.

(r) For exceptionally high power levels, it might be advantageous to provide for more than one high-power inverter. However, it would not normally be necessary to provide for more than one low-power inverter.

(s) It is believed that the present invention and its several attendant advantages and features will be understood from the preceeding description. However, without departing from the spirit of the invention, changes may be made in its form and in the construction and interrelationships of its component parts, the form herein presented merely representing the presently preferred embodiment.

I claim:

1. In an operating system for a skin treatment apparatus, said system being adapted to be powered from an ordinary electric utility power line and having a plurality of fluorescent lamp means, each such lamp means: (i) having a pair of thermionic cathodes, each cathode having a pair of input terminals, (ii) being operative to provide radiation suitable for beneficially affecting human skin exposed to this radiation, and (iii) requiring for proper operation that a relatively low-magnitude cathode voltage be applied across the input terminals of each cathode and that a relatively high-magnitude current-limited main voltage be applied between the two cathodes; the improvement comprising:

rectifier and filter means connected with said power line and operable to provide across a pair of DC terminals a DC voltage of substantially constant magnitude;

inverter means connected with said DC terminals and, in response to said DC voltage, operable to provide a first AC voltage at a first AC output and a second AC voltage at a second AC output;

for each lamp means, a lamp ballasting means operable: (i) whenever receiving said first AC voltage at a first set of input terminals, to provide therefrom said relatively low-magnitude cathode voltage, and (ii) whenever receiving said second AC voltage at a second set of input terminals, to provide therefrom said relatively high-magnitude current-limited main voltage; said lamp ballasting means comprising protection means whereby, if the lamp means does not start operation within a brief period after having been provided with said relatively high-magnitude current-limited main voltage, an effective short circuit is placed between the cathodes of said lamp means; and distribution means connected with said first and second AC outputs and operative to provide said first AC voltage at said first set of input terminals and said second AC voltage at said second set of input terminals.

2. The improvement of claim 1 wherein, upon being initially provided with said DC voltage, said inverter means does not provide said second AC voltage until some predetermined time after having provided said first AC voltage.

3. The improvement of claim 1 wherein said inverter means comprises control means operable to control the provision and non-provision of said second AC voltage.

4. In an operating system for a skin treatment apparatus, said system being adapted to be powered from an ordinary electric utility power line and having a plurality of fluorescent lamp means, each lamp means: (i) having a pair of thermionic cathodes, each cathode having a pair of input terminals, (ii) being operative to provide radiation suitable for beneficially affecting human skin exposed to this radiation, and (iii) requiring for proper operation that a relatively low-magnitude cathode voltage be applied across the input terminals of each cathode and that a relatively high-magnitude current-limited main voltage be applied between the two cathodes; the improvement comprising:

rectifier and filter means connected with said power line and operable to provide across a pair of DC terminals a DC voltage of substantially constant magnitude;

inverter means connected with said DC terminals and operable to provide a first AC voltage at a first AC output and a second AC voltage at a second AC output, said inverter means having a control input receptive of control signals and operative in response thereto to selectively provide or non-provide said second AC voltage at said second AC output;

for each lamp means, a lamp ballasting means operable: (i) whenever receiving said first AC voltage at a first set of input terminals, to provide therefrom said relatively low-magnitude cathode voltage, and (ii) whenever receiving said second AC voltage at a second set of input terminals, to provide therefrom said relatively high-magnitude current-limited main voltage;

distribution means operative to provide connection between said first AC output and said first set of input terminals, as well as between said second AC output and said second set of input terminals; and control means operative to provide said control signals, thereby to selectively provide or non-provide said main voltage.

5. The improvement of claim 4 wherein said main voltage is not provided until after said cathode voltage has been provided for a minimum time period.

6. The improvement of claim 5 wherein said main voltage is not provided until after said cathodes have become thermionic.

7. The improvement of claim 4 wherein said inverter means comprises two separate inverters.

8. In an operating system for a skin treatment apparatus, said system being adapted to be powered from an ordinary electric utility power line and having a plurality of fluorescent lamp means, each lamp means: (i) having a pair of thermionic cathodes, each cathode having an input terminal, (ii) being operative to provide radiation suitable for beneficially affecting human skin exposed thereto, and (iii) requiring for proper operation that a relatively high-magnitude current-limited main voltage be applied between the two cathodes; the improvement comprising:

rectifier and filter means connected with said power DC voltage of substantially constant magnitude;

inverter means connected with said DC terminals and operable to provide an AC voltage at an AC output, said inverter means having a control input receptive of control signals and operative in response thereto to selectively provide or non-provide said AC voltage at said AC output;

for each lamp means, a lamp ballasting means operable, whenever receiving said AC voltage at a set of input terminals, to provide therefrom said relatively high-magnitude currentlimited main voltage;

distribution means operative, for each of said lamp ballasting means, to provide connection between said AC output and said set of input terminals; and control means operative to provide said control signals, thereby to selectively provide or non-provide said main voltage.

9. The improvement of claim 8 wherein said AC voltage is substantially a squarewave voltage.

10. The improvement of claim 8 and means operative to make said main voltage have a substantially sinusoidal waveshape.

11. The improvement of claim 8 wherein said lamp ballasting means comprises an L-C circuit that is substantially resonant at the fundamental frequency of said AC voltage, thereby causing any current flowing through said lamp means to have a substantially sinusoidal waveshape.

12. The improvement of claim 11 wherein said L-C circuit is series-excited by said AC voltage and parallel-loaded by said lamp means.

13. In an operating system for a skin treatment apparatus, the skin treatment apparatus being defined as a mechanically integral movable entity, said system being adapted to be powered from an ordinary electric utility power line and having a plurality of fluorescent lamp means, each lamp means: (i) having a pair of thermionic cathodes, each cathode having an input terminal, (ii) being operative to provide radiation suitable for beneficially affecting human skin exposed thereto, and (iii) requiring for proper operation that a relatively high-magnitude current-limited main voltage be applied between the two cathodes; the improvement comprising:

rectifier and filter means connected with said power line and operable to provide across a pair of DC terminals a DC voltage of substantially constant magnitude;

inverter means connected with said DC terminals and operable to provide an AC voltage at an AC output; and for each lamp means, a ballasting means: (i) connected with said AC output, (ii) comprising reactive current-limiting means and (iii) operable to provide from said AC voltage said relatively high-magnitude current-limited main voltage; the improvement being so operative that the failure of one of said fluorescent lamp means does not affect the provision of the AC voltage.

14. The improvement of claim 13 wherein said L-C circuit is series-excited by said AC voltage and parallel-loaded by said lamp means.

15. The improvement of claim 14 wherein a circuit protection means is effectively connected in parallel with said lamp means and operative to prevent excessive voltages from developing within said ballasting means.

16. The improvement of claim 14 wherein said circuit protection means comprises voltage limiting means manifestly operative to limit the voltage developing between said thermionic cathodes to a magnitude that is effective for proper starting of said lamp means.

17. The improvement of claim 16 wherein said circuit protection means is operative to provide an effective short circuit between said cathodes in case said circuit protection means has been operative, for longer than a certain predetermined brief period, to limit the voltage developing between said thermionic cathodes to a magnitude that is effective for proper starting of said lamp means.

18. The combination of a skin treatment apparatus with an electronic fluorescent lamp ballasting system:

said skin treatment apparatus being defined as a mechanically integral movable entity and comprising:

a plurality of fluorescent lamp means, each lamp means: (i) having a pair of thermionic cathodes, (ii) being operative to provide photic radiation suitable for beneficially affecting human skin exposed thereto, and (iii) requiring for proper operation that a relatively high-magnitude current-limited main voltage be applied between said cathodes;

said electronic ballasting system comprising:

rectifier and filter means operable to connect with an ordinary electric utility power line and operable to provide across a pair of DC terminals a DC voltage of substantially constant magnitude;

inverter means connected with said DC terminals and operable to provide an AC voltage at an AC output; and for each lamp means, a ballasting means: (i) connected with said AC output, (ii) comprising reactive current-limiting means, and (iii) operable to provide from said AC voltage said relatively high-magnitude current-limited main voltage.

19. The combination of claim 18 wherein said L-C circuit is series-excited by said AC voltage and parallel-loaded by said lamp means.

20. The combination of claim 18 wherein said inverter means comprises control input means receptive of a control signal and, for as long as said control signal is being provided, operative to prevent said AC voltage from being provided the electronic ballasting system being so operative that the failure of one of said fluorescent lamp means does not affect the provision of the AC voltage.

* * * * *